United States Patent [19]

Feinauer et al.

[11] 3,953,405

[45] Apr. 27, 1976

[54] METHOD FOR PREPARING LOW PILLING EFFECT POLYESTER FIBER PRODUCTS

[75] Inventors: Roland Feinauer; Karl-Heinz Magosch; Jörn Rüter, all of Marl, Germany

[73] Assignee: Chemische Werke Huls Aktiengesellschaft

[22] Filed: Aug. 5, 1974

[21] Appl. No.: 495,074

[30] Foreign Application Priority Data

Sept. 11, 1973 Germany ..... 2345653

[52] U.S. Cl. ..... 260/75 T; 204/159.19; 264/22; 264/176 F

[51] Int. Cl.[2] ..... C08G 63/12

[58] Field of Search ..... 260/75 R, 75 M, 75 T; 264/176 F, 22, 210 F, 211; 204/159.19, 159.14

[56] References Cited

UNITED STATES PATENTS 3,822,239 7/1974 Chimara et al. ..... 260/75 R

FOREIGN PATENTS OR APPLICATIONS 42-20850 10/1967 Japan ..... 260/75 R 45-10764 4/1970 Japan ..... 264/17.1

45-18314 6/1970 Japan ..... 260/75 R 45-29911 9/1970 Japan ..... 260/75 R 45-32437 10/1970 Japan ..... 260/75 R

*Primary Examiner*—Jay H. Woo

*Attorney, Agent, or Firm*—Gilbert L. Wells

[57] ABSTRACT

An improvement in the process of melt spinning ethylene terephthalate polyester to produce textile fibers with decreased pilling in the threads, fibers or fabrics made therefrom. The ethylene terephthalate is melt polymerized in the presence of a condensation catalyst to a final temperature of about 250°C – 300°C and a final pressure of less than 10 mm mercury to form an anhydrous melt. A substituted cyclobutanedecarboxylic acid, preferably α-truxillic acid, is added to the melt-polymerization at a concentration of about 0.05–5 molepercent of the acid component. Melt spinning of the modified polyester is carried out and the fibers are irradiated with high energy light.

14 Claims, 1 Drawing Figure

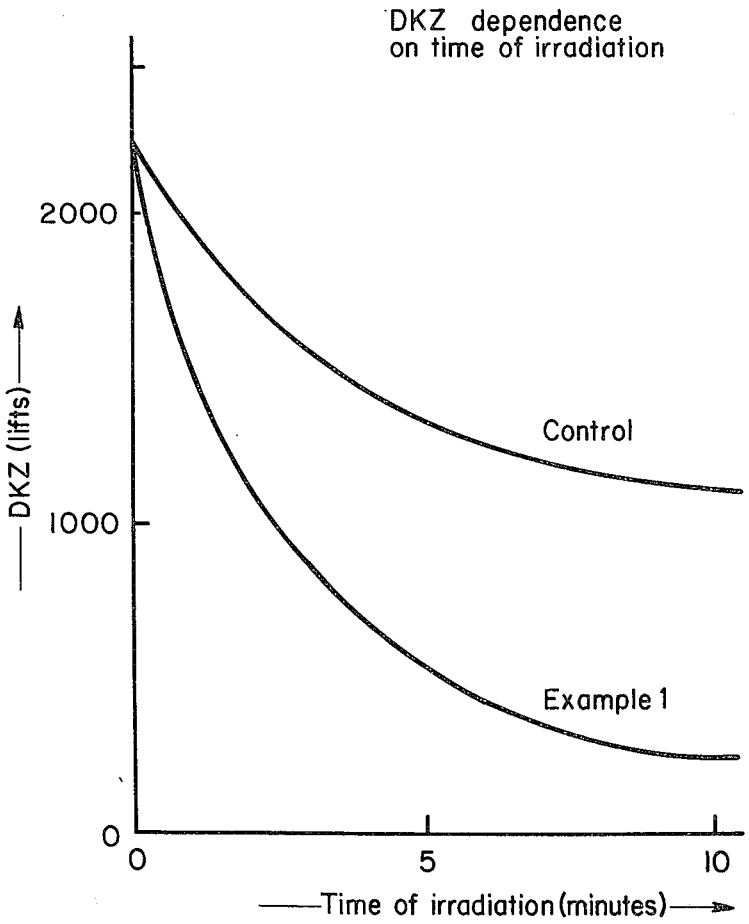
DKZ dependence
on time of irradiation
2000
1000
0
DKZ (lifts)
Control
Example 1
0
5
10
Time of irradiation (minutes)

METHOD FOR PREPARING LOW PILLING EFFECT POLYESTER FIBER PRODUCTS

CROSS REFERENCE TO A RELATED APPLICATION

Applicants claim priority under 35 U.S.C. 119 for Application P 23 45 653.3, filed Sept. 11, 1973 in the Patent Office of the Federal Republic of Germany.

BACKGROUND OF THE INVENTION

The field of the invention is synthetic resins from polyhydric alcohol-polycarboxylic acid reaction products. The invention is particularly related to a process for the manufacture of low pilling-effect polyester fiber products.

The state of the art of the present invention may be ascertained by reference to the Kirk-Othmer "Encyclopedia of Chemical Technology", Vol. 16 (1968), pages 143–159, under the section entitled "Polyester Fibers"; U.S. Pat. No. 2,465,319 which shows the preparation of polyethylene terephthalate; U.S. Pat. No. 3,391,123 of Stedley which issued July 2, 1968, and shows the state of the art of improving the pilling effect of polyethylene terephthalate textile fibers; West German Patents 1,148,520 and 1,290,516 of Kretsch-Hothum et al which shows an improvement in the dyeability of polyesters by the addition of cyclobutanedicarboxylic acid to the melt-polymerization; and USSR Patent 322,985 which issued May 15, 1972 and shows the preparation of the α-truxillic acid preferred for use in the present invention, the disclosures of which are incorporated herein.

Because of the large number of outstanding properties such as high melting point, chemical corrosion resistance, stability with respect to heat, hot water and light, and also on account of their mechanical properties, threads and fibers made of polyethylene terephthalate have achieved large significance in the garment industry.

However, polyester fibers also do suffer from drawbacks. One of these is the so-called pilling effect, which is caused by fibers being pulled out of the cloth during wear and then twisting into small spheres firmly anchored to the cloth. The fabric surface thereby assumes an unpleasant appearance and decreases the quality of the particular item.

Many attempts have been undertaken to remedy this drawback in polyester by various steps.

The most frequently used method consists in reducing the molecular weight of the polyester and in correspondingly reduced specific viscosities (hereafter abbreviated by RSV) of about 0.35 – 0.45 dl/g (deciliters per gram as measured at a concentration of 0.23 g in 100 ml phenol and tetrachloroethane (60 : 40) at 25°C similar to German Industrial Standard DIN 53728 page 3), and therewith obtaining a reduction in thread strength, as disclosed in Japanese Patent 24,932 which issued in 1965. However, extrusion or melt spinning of such a material causes appreciable difficulties on account of the low viscosity of the melt.

Another approach consists in preparing polyesters containing such compounds as alcohols or carboxylic acids with three or more functional groups, for instance glycerine, pentaerythrite or trimesinic acid as disclosed in German Published Application 1,928,436.

Partially branched polyesters are obtained in the process. The drawback of this method arises from the very precise dosage required of the branching components, which may not always be ensured in industrial practice. Therefore, there is danger of polyester reticulation which may cause failure of the entire polycondensing system.

Again, many attempts have been undertaken to destructively test polyester fibers and fabrics made therefrom by treating them at high temperatures with water, soda, ammonium, hydrazine, carboxylic acids or alcohols as disclosed in Czech Patent 108,680; Dutch Patent 91,330; French Patent 1,551,050; Japanese Patent 7,122,174; and German Published Application 1,024,482. It has been found, however, that such decomposition presents difficulties relating to control and reproducibility. In many cases, attempts were undertaken to create weak spots in the molecule by incorporating chain links with hetero-atoms, especially silicon, as disclosed in U.S. Pat. No. 3,335,211 and German Published application 1,273,123; boron as disclosed in U.S. Pat. No. 3,335,211 and German Published Application 1,469,127, or aluminum as disclosed in German Published Application 1,545,039, which may also cause branching or reticulation, with hydrolytic dissociation being subsequently feasible at these weak spots. Again, difficulties are encountered regarding reproducibility of these products. Furthermore, the operation must be entirely free from water up to the time of the desired hydrolytic decomposition or reduction. It is generally known that special difficulties are caused by the latter requirement.

As clearly shown above, all the known methods suffer from a series of drawbacks.

SUMMARY OF THE INVENTION

Having in mind the limitations of the prior art, it is an object of the present invention to develop an improved process for the manufacture of low pilling effect polyester fibers.

This object is achieved in the present invention by irradiating threads, fibers or fabrics made of polyesters containing from about 0.05 to 5.0 mole percent (with respect to the acid component) of a substituted cyclobutanedicarboxylic acid, by means of high energy light.

A polyester suitable for the process of the present invention consists (aside from containing a substituted cyclobutanedicarboxylic acid) in whole or predominantly of a polyethylene-terephthalate. The polyethylene terephthalate may be modified with up to 15 mole percent of other dicarboxylic acids such as isophthalic acid; 1,5- or 2,6-naphthalenedicarboxylic acid; cyclohexanedicarboxylic acid-1,4; adipic acid or sebacic acid; and/or other diols such as 1,4-dimethylolcyclohexane, butanediol-1,4; neopentylglycol, hexanediol-1,6 or 3,3,5-trimethylhexanediol-1,6.

The polyester contains from about 0.05 to 5.0 mole percent preferably from 0.1 to 2.0 mole percent, of a substituted cyclobutanedicarboxylic acid, preferably α-truxillic acid, of the formula shown below, with respect to the acid component, this content being condensed into the polyester.

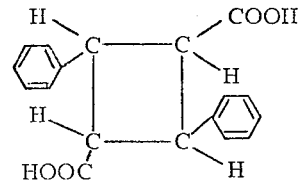

In addition to α-truxillic acid, which is also designated as 1,3-cyclobutanedicarboxylic acid-2,4-diphenyl and the dimethyl ester thereof, the following substituted cyclobutanedicarboxylic acids and esters are useful in the present invention: β-Truxinic acid (1,2-cyclobutanedicarboxylic acid-3,4-diphenyl), the stereoisomeric δ-Truxinic acid, the phenyl-substituted derivatives of these acids (containing one or more methyl and/or ethyl groups, methoxy or ethoxy groups, halogens such as chlorine and bromine, e.g.,) and the methyl and ethyl esters of all of these acids.

The preparation of the polyesters useful in the present invention falls outside the object of the present invention. They are prepared as disclosed in U.S. Pat. Nos. 2,465,319 and 3,391,123, in the presence of conventional ester interchange catalysts such as calcium acetate, zinc acetate, manganese acetate or of polycondensation catalysts such as compounds of antimony, germanium or gallium, and may contain further additions of conventional heat and oxidation stabilizers such as sterically hindered phenols, secondary aromatic amines, sensitizers such as benzophenone or benzoine derivatives, or pigmented means such as titanium dioxide.

The substituted cyclobutanedicarboxylic acid, for instance α-truxillic acid, is added to the reagents at an arbitrary time, in its own form or in that of a derivative, preferably methyl ester and the addition preferably takes place prior to ester interchange.

Especially ultra-violet light, particularly that with wave lengths from about 250 to 400 millimicrons, is suitable as the high energy light.

The polyesters obtained thereby are extrusion-spun in conventional manner, as disclosed in U.S. Pat. No. 3,391,123. Appropriately, the fibers or threads are first stretched and then subjected to UV irradiation. However, subsequent treatment of the fabrics so made is also possible. Irradiation takes place so that the threads, the fibers or the fabric, are at rest or moving, i.e., carried underneath or above the irradiation source. The length of irradiation is determined by the desired pilling effect and depends on the distance from and the intensity of the radiation source. Generally this length is from one second to thirty minutes. The distance between irradiated sample and radiation source is varied from five to one hundred cms. This distance depends on irradiation time and on the intensity of the source, which may be varied from 25 to 1,000 watts. More intense radiation is employed where appropriate.

Radiation efficiency is determined in accordance with the wire material strength (abbreviated hereafter by DKZ) of K. H. Gruenewald, Chemiefasern 12, 853 (1952), which is a measure of the pilling effect. Details are found in the cited work.

A great advantage of the process of the present invention resides in the physical property of having the viscosity of the polyester fall in the ordinary range from 0.5 to 0.7 dl/g (deciliters/gram).

Another advantage is that the modifying component is present in so minute an amount that the polyester properties are not adversely affected by it.

BRIEF DESCRIPTION OF THE DRAWING

The drawing appended herewith is a graphical representation showing the DKZ dependence versus time of irradiation.

DESCRIPTION OF THE PREFERRED EMBODIMENTS

The following examples describe the invention in further detail, without however limiting it thereby:

EXAMPLE 1

The following ingredients are placed in an ester interchange reactor equipped with a stirrer, a double heating jacket and a fractionating column:

1,930 gm of dimethylterephthalate
16.2 gm of α-truxillic acid dimethylester (corresponding to 0.5 mole percent with respect to the acid component)
1,240 gm of ethyleneglycol
0.6 gm of zinc acetate.

The mixture is heated and at 150°C, methanol starts distilling off. Once methanol distillation has ceased at 200°C, generally no later than 3 hours, the ester interchange product is transferred into the polycondensation reactor. The following is then added:

1.2 gm of triphenylphosphate, and
0.194 gm of antimony oxide ($Sb_2O_3$).

Subsequently the temperature is gradually increased to 280°C, the pressure being gradually decreased to approximately 0.1 torr (1 torr = 1 mm Hg). Polycondensation is discontinued when the power input, as measured while stirring the reactor contents, corresponds to a melt viscosity of about 900 poises at a temperature of 285°C.

The RSV value of the colorless polyester (0.23 g measured in 100 ml of 60/40 phenol/tetrachloroethane at 25°C) is 0.63 dl/g, and the melting point (determined from differential thermal analysis) is 257°C.

The material is spun through an extrusion die or spinneret with 8 holes 0.25 mm in diameter and at a temperature of 315°C and the yarn is wound at a rate of 640 meters/minute. Subsequently it is stretched in a ratio of 1:4.

The thread properties are as follows:
titer = 36/8 dtex
tear resistance = 2.99 p/dtex
elongation = 35.5 percent Thereafter, the threads are irradiated by a high pressure mercury lamp of 125 watt capacity from a distance of 10 cm and for a time of 0 – 10 minutes.

Following various elapsed times, the DKZ is determined at individual capillaries. Table 1 lists the mean values from 48 single measurements as a function of time of irradiation and a graph of these data is shown in the attached drawing.

TABLE 1

Polyester threads following uv irradiation.

| time of irradiation (minutes) | 0 | 1 | 2 | 5 | 10 |
|---|---|---|---|---|---|
| DKZ (lift) | 2260 | 2110 | 1160 | 520 | 260 |

For purposes of comparison, polyester threads of the following properties
titer = 36/8 dtex
tear resistance = 3.12 p/dtex
elongation = 35.7 percent
and containing no α-truxillic acid are irradiated under the same conditions. As shown by the values listed in Table 2, the DKZ decays much more slowly and not as far as in the threads containing α-truxillic acid.

TABLE 2

| time of irradiation (minutes) | 0 | 1 | 3 | 5 | 10 |
|---|---|---|---|---|---|
| DKZ (lift) | 2250 | 2100 | 1490 | 1330 | 1110 |

Again, decay of the DKZ is observed in the graph shown in the attached drawing.

When the ester interchange catalyst used, is replaced by calcium or manganese acetate, or when the polycondensation catalyst is replaced by germanium dioxide or gallium lactate, similar results are obtained. When the p-methoxy disubstituted α-truxillic acid dimethylester is used instead of the α-truxillic acid dimethylester, then a similar result ist obtained.

When 5, 10 or 15 mole percent isophthalic acid dimethylester, naphthalene dicarboxylic acid-2,6-dimethylester are used in addition to dimethylterephthalate, or when 5, 10 or 15 mole percent of 1,4-dimethylolcyclohexane, butanediol-1,4 or neopentylglycol are used in addition to ethyleneglycol, then a similar decay of DKZ is obtained.

EXAMPLES 2 THROUGH 6

Polyester preparation and thread irradiation were performed as described in Example 1. The added amounts of α-truxillic acid dimethylester were varied. This and the other data are listed in Table 3 and for the sake of completeness, Table 3 incorporates also Table 1.

Furthermore, the distance from the radiation source to the irradiated sample was varied from 5 to 100 cms and the source intensity also was varied. It was found that when the time of irradiation is shorter, the stronger is the radiator and the lesser the distance, and inversely.

Fewer than 1,000 lifts, preferably from 500 to 600 approximately, at a thread loading of two grams, are considered desirable for a polyester fiber adequately lacking in pilling effect.

2. The process of claim 1, wherein said substituted cyclobutane-dicarboxylic acid is a phenylsubstituted one.

3. The process of claim 2, wherein said substituted cyclobutanedicarboxylic acid is α-truxillic acid.

4. The process of claim 3, wherein the concentration of said α-truxillic acid is about 0.1 to 2.0 mole percent, with respect to the acid component.

5. The process of claim 1, wherein said high energy light is ultra violet light with wave lengths of about 250 to 400 millimicrons.

6. An improvement in the process of melt spinning ethylene terephthalate polyester to produce textile fibers having substantially decreased pilling in fabrics containing the fibers comprising melt polymerizing ethylene terephthalate in the presence of a condensation catalyst to a final temperature of about 250°C to 300°C and a final pressure of less than 10 mm of mercury to form an anhydrous melt, the improvement comprising:

conducting said melt polymerizing in the presence of about 0.05 to 5.0 mole percent, with respect to the ester component, of a substituted cyclobutanedicarboxylic ester;

melt spinning said anhydrous melt; and exposing said melt spun fibers to irradiation with high energy light.

7. The process of claim 6, wherein said substituted cyclobutanedicarboxylic ester is a phenylsubstituted one.

8. The process of claim 7, wherein said substituted cyclobutanedicarboxylic ester is the dimethyl ester of α-truxillic acid.

9. The process of claim 8, wherein the concentration of said dimethyl ester of a α-truxillic acid is about 0.1 to 2.0 mole percent, with respect to the ester component.

10. The process of claim 6, wherein said high energy light is ultra violet light with wave lengths of about 250 to 400 millimicrons.

TABLE 3

| Example | Mole % α-truxillic acid | Melting point (°C) of polyester | RSV (dl/g) | Titer (dtex) | Tear Resistance | Elongation | DKZ as function of UV irradiation 0 | 1 | 2 | 3 (min) | 5 | 10 | 30 |
|---|---|---|---|---|---|---|---|---|---|---|---|---|---|
| 2 | 0.1 | 258 | 0.58 | 36/8 | 3.11 | 34.2 | 2300 | 2150 | 1190 | 950 | 620 | 250 | 150 |
| 3 | 0.25 | 258 | 0.60 | 36/8 | 3.05 | 34.7 | 2240 | 2170 | 1220 | 880 | 580 | 270 | 110 |
| 1 | 0.5 | 257 | 0.63 | 36/8 | 2.99 | 35.5 | 2260 | 2110 | 1160 | — | 520 | 260 | 120 |
| 4 | 0.75 | 257 | 0.63 | 36/8 | 2.95 | 35.8 | 2210 | 2090 | 1200 | 910 | 490 | 210 | 110 |
| 5 | 1.0 | 255 | 0.58 | 36/8 | 3.01 | 35.0 | 2190 | 2010 | 1230 | 870 | 510 | 280 | 110 |
| 6 | 2.0 | 251 | 0.57 | 36/8 | 2.91 | 36.2 | 2200 | 2050 | 1170 | 830 | 550 | 250 | 120 |

We claim:

1. An improvement in the process of melt spinning ethylene terephthalate polyester to produce textile fibers having substantially decreased pilling in fabrics containing the fibers comprising melt polymerizing ethylene terephthalate in the presence of a condensation catalyst to a final temperature of about 250°C to 300°C and a final pressure of less than 10 mm of mercury to form an anhydrous melt, the improvement comprising:

conducting said melt polymerizing in the presence of about 0.05 to 5.0 mole percent, with respect to the acid component, of a substituted cyclobutanedicarboxylic acid;

melt spinning said anhydrous melt; and exposing said melt spun fibers to irradiation with high energy light.

11. The process of claim 2, wherein said phenyl substituted cyclobutane dicarboxylic acid is selected from the group consisting of α-truxillic acid, dimethyl ester of α-truxillic acid, diethyl ester of α-truxillic acid, β-truxinic acid, dimethyl ester of β-truxinic acid, diethyl ester of β-truxinic acid, δ-truxinic acid, dimethyl ester of δ-truxinic acid and diethyl ester of δ-truxinic acid.

12. The process of claim 7, wherein said phenyl substituted cyclobutane dicarboxylic acid is selected from the group consisting of α-truxillic acid, dimethyl ester of α-truxillic acid, diethyl ester of α-truxillic acid, β-truxinic acid, dimethyl ester of β-truxinic acid, diethyl ester of β-truxinic acid, δ-truxinic acid, dimethyl ester of δ-truxinic acid and diethyl ester of δ-truxinic acid.

13. The product obtained by the process of claim 1.

14. The product obtained by the process of claim 6.

* * * * *